US006959578B2

(12) United States Patent
Horii et al.

(10) Patent No.: US 6,959,578 B2
(45) Date of Patent: Nov. 1, 2005

(54) MULTI-ROW ROLLING MILLS, METHODS OF OPERATING THESE MILLS, AND ROLLING EQUIPMENT USING THE MILLS

(75) Inventors: Kenji Horii, Hitachi (JP); Akira Goto, Hitachi (JP); Hideo Kobayashi, Hitachi (JP); Syunsaku Kasai, Hitachi (JP); Yujiro Kobayashi, Hitachi (JP); Takao Sakanaka, Hitachi (JP); Motoyuki Fujii, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/101,477

(22) Filed: Mar. 20, 2002

(65) Prior Publication Data

US 2003/0070466 A1 Apr. 17, 2003

(30) Foreign Application Priority Data

Oct. 12, 2001 (JP) ..... 2001-314697

(51) Int. Cl.[7] ..... B21B 13/00
(52) U.S. Cl. ..... 72/237; 72/250
(58) Field of Search ..... 72/229, 239, 226, 72/224, 240, 250, 238, 5, 227, 251

(56) References Cited

U.S. PATENT DOCUMENTS

| | | | | | |
|---|---|---|---|---|---|
| 1,964,503 | A | * | 6/1934 | Coryell | 72/229 |
| 2,058,717 | A | * | 10/1936 | Paterson | 72/227 |
| 3,147,648 | A | * | 9/1964 | Sendzimir et al. | 72/43 |
| 3,693,393 | A | * | 9/1972 | Nellen et al. | 72/226 |
| 5,934,130 | A | * | 8/1999 | Kajiwara et al. | 72/249 |
| 6,098,439 | A | * | 8/2000 | Lecrivain | 72/239 |
| 6,286,354 | B1 | * | 9/2001 | Kajiwara et al. | 72/237 |

FOREIGN PATENT DOCUMENTS

| | | | | |
|---|---|---|---|---|
| JP | 60177733 | * | 9/1987 | B21B/39/14 |
| JP | 01153883 A | * | 6/1989 | F16L/3/20 |
| JP | HEI 9-239413 | | 9/1997 | |
| JP | 09239413 A | * | 9/1997 | B21B/31/02 |
| JP | 11000702 A | * | 1/1999 | B21B/31/02 |

* cited by examiner

*Primary Examiner*—Lowell A. Larson
(74) *Attorney, Agent, or Firm*—Crowell & Moring LLP

(57) ABSTRACT

A multi-row rolling mill has in one housing at least two groups of rolls including at least one pair of work rolls, and constructed so that when the workpiece to be rolled is passed one time, it can be rolled using said respective work rolls. The multi-row rolling mill is characterized in that it is provided with a means for removing the workpiece if the workpiece stops moving between said roll groups.

5 Claims, 10 Drawing Sheets

MULTI-ROW ROLLING MILLS, METHODS OF OPERATING THESE MILLS, AND ROLLING EQUIPMENT USING THE MILLS

BACKGROUND OF INVENTION

This application claims the priority of Japanese Application No. 2001-314967, filed in Japan on Oct. 12, 2001, the disclosure of which is expressly incorporated by reference herein.

1. Field of the Invention

The present invention relates to multi-row rolling mills, methods of operating these mills, and rolling equipment that uses the mills.

2. Description of Prior Art

Hot coils, the materials to be cold-rolled, are produced using hot-rolling equipment. Under prior art, slabs 200 mm or more in thickness are cast by a continuous casting machine and these slabs are then provided with unidirectional or reversing-type rolling by a plurality of pre-rolling mills to form bar materials. After these bar materials have been further rolled to the required thickness by a tandem rolling mill group consisting of a plurality of continuously arranged rolling mills, the bar materials are cooled by a cooling apparatus and wound by a coiler to form the hot coils mentioned above. Such hot-rolling equipment intended for mass production is very large in scale.

In recent years, importance has been attached to the recycling of iron scraps, coupled with the occurrence thereof in great quantities, and the tendency for distributed arrangement of small-scale small-volume production equipment, rather than integrated installation of large-scale large-volume production equipment, has been increasing. This tendency has resulted in construction of so-called "mini-hot" systems, namely, hot-rolling equipment up to about one million tons per annum in terms of hot-coil production scale. With reference to the production capabilities of cold-rolling equipment, on the other hand, tandem rolling equipment with a continuous arrangement of four to five rolling mills is up to about 1.5 million tons per annum in production volume, and the maximum production volume by single-stand reversing cold-rolling mills ranges from about 0.3 to 0.5 million tons per annum. For cold-rolling equipment connected to small-scale small-volume production equipment called the "mini-hot", it is appropriate to have a production scale up to one million tons per annum. An example of an equivalent to such equipment is the twin-stand tandem reversing mill described on page 144 of STEEL TIMES APRIL 2000 (hereinafter, this mill is referred to as the twin-stand reversing mill).

As set forth in Japanese Patent Application Laid-Open Publication No. Hei 9-239413, rolling equipment having at least two groups of rolls in one pair of housings, designed so as to enable rolling to be repeated at least twice during one path, and capable of achieving a production scale up to one million tons per annum by creating a high-pressure atmosphere within a short time by use of a single-stand reversing mill (hereinafter, such equipment is referred to as the twin-reversing mill), has also become available.

SUMMARY OF THE INVENTION

For the twin-stand reversing mill, the material to be rolled is reeled out by tension reels arranged in front of and at the rear of a pre-rolling machine and is then rolled by the main rolling machine while being wound. The clearance between the two stands is as great as up to about 5,000 mm, which is almost the same as that of a large-size tandem mill, and to ensure the proper arrangement of the machine components, a distance of about 5,000 mm also needs to be provided between the front and rear tension reels and the main rolling machine. Accordingly, a total of about 20 m of the entire thinned-down material which has been wound into coil form after rolling, namely, about 10 m of the leading and trailing ends each of the material, is not rolled to the desired thickness and productivity decreases correspondingly. For the recent types of tandem rolling mills, since hot coils are connected upstream by welding and then rolled continuously, their productivity is uneven because only the extremely narrow areas including the welded connections may not be rolled to the desired thickness. The above-described twin-stand reversing mill, therefore, is extremely high in product loss ratio. The twin-stand reversing mill, although better in production yield than the single-stand reversing mill, is not sufficient in production volume, since the former mill does not does not have such a stand-to-stand distance as provided in the latter mill.

For the twin-reversing mill, on the other hand, production yield can be improved since the arrangement of one pair of roll groups in a housing(s) enables the clearance between the roll groups to be reduced below 2,000 mm. Since the clearance between the roll groups of the twin-reversing mill is short, human access to the roll groups in the event of workpiece breakage or thinning-down trouble is difficult and operations from removing the workpiece from the roll groups to recovering the corresponding machine components become time-consuming jobs, with the result that the rolling equipment decreases in availability.

The present invention is intended to improve the recoverability of a rolling mill from trouble by reducing the distance between roll groups.

A multi-row rolling mill based on the present invention is one having in one housing at least two groups of rolls including at least one pair of work rolls, and constructed so that when the workpiece to be rolled is passed one time, it can be rolled using said respective work rolls, wherein the multi-row rolling mill is characterized in that it is provided with a means for removing the workpiece if it stops moving between said roll groups.

A multi-row rolling mill based on the present invention according to certain preferred embodiments has in one housing at least two groups of rolls including at least one pair of work rolls, provided with a columnar support member between said roll groups, and constructed so that when the workpiece to be rolled is passed one time, it can be rolled using said respective work rolls, wherein the multi-row rolling mill is characterized in that it is provided with a means for removing the workpiece if it stops moving between said roll groups.

A rolling equipment system based on the present invention according to certain preferred embodiments is characterized in that a multi-row rolling mill having in one housing at least two groups of rolls including at least one pair of work rolls, constructed so that when the workpiece to be rolled is passed one time, it can be rolled using said work rolls, and provided with a means for removing the workpiece if it stops moving between said roll groups, is applied to reversing cold-rolling equipment, or in that at least one such rolling mill is installed inside tandem rolling equipment.

A rolling equipment system based on the present invention according to certain preferred embodiments is characterized in that in a multi-row rolling mill having in one housing at least two groups of rolls including at least one pair of work rolls, constructed so that when the workpiece to be rolled is passed one time, it can be rolled using said respective work rolls, and provided with a means for removing the workpiece if it stops moving between said roll groups, a first roll-side shifting unit movable in a rolling direction and having at least two loading portions which can be loaded with rolls is provided at the roll removal side of the multi-row rolling mill, and a second roll-side shifting unit movable in the rolling direction and having at least two loading portions which can be loaded with rolls is provided at the opposite side of said first roll-side shifting unit in the multi-row rolling mill.

Rolling equipment based on the present invention according to certain preferred embodiments is characterized in that in a multi-row rolling mill having in one housing at least two groups of rolls including at least one pair of work rolls, constructed so that when the workpiece to be rolled is passed one time, it can be rolled using said respective work rolls, and provided with a means for removing the workpiece if it stops moving between said roll groups, a roll-side shifting unit movable in a rolling direction and having at least four loading portions which can be loaded with rolls is provided at the roll removal side of the multi-row rolling mill.

A multi-row rolling mill operating method based on the present invention according to certain preferred embodiments relates to a multi-row rolling mill which has in one housing at least two groups of rolls including at least one pair of work rolls and is constructed so that when the workpiece to be rolled is passed one time, it can be rolled using said respective work rolls, wherein the multi-row rolling mill operating method is characterized in that if the workpiece stops moving between said roll groups, removal of the workpiece will be accomplished by broadening the clearance between one pair of work rolls included in at least one roll group.

A multi-row rolling mill operating method based on the present invention according to certain preferred embodiments relates to a multi-row rolling mill which has in one housing at least two groups of rolls including at least one pair of work rolls and is constructed so that when the workpiece to be rolled is passed one time, it can be rolled using said respective work rolls, wherein the multi-row rolling mill operating method is characterized in that if the workpiece stops moving between said roll groups, removal of the workpiece will be accomplished by pulling out at least one of the upper rolls in at least one roll group to the outside of the rolling mill.

A multi-row rolling mill operating method based on the present invention according to certain preferred embodiments relates to a multi-row rolling mill which has in one housing at least two groups of rolls including at least one pair of work rolls, constructed so that when the workpiece to be rolled is passed one time, it can be rolled using said respective work rolls, and provided with a through-plate guide for guiding the traveling of the workpiece between said roll groups, wherein the multi-row rolling mill operating method is characterized in that if the workpiece stops moving between said roll groups, removal of the workpiece will be accomplished by moving said through-plate guide from the position at which the traveling of the workpiece is to be guided, to any other position.

Other objects, advantages and novel features of the present invention will become apparent from the following detailed description of the invention when considered in conjunction with the accompanying drawings.

BRIEF DESCRIPTION OF THE DRAWINGS

FIG. 3(*b*) is yet another partial cross-sectional view of the rolling equipment of FIGS. 1 and 2.

DETAILED DESCRIPTION OF THE INVENTION

Description of Embodiments

Figure 1:
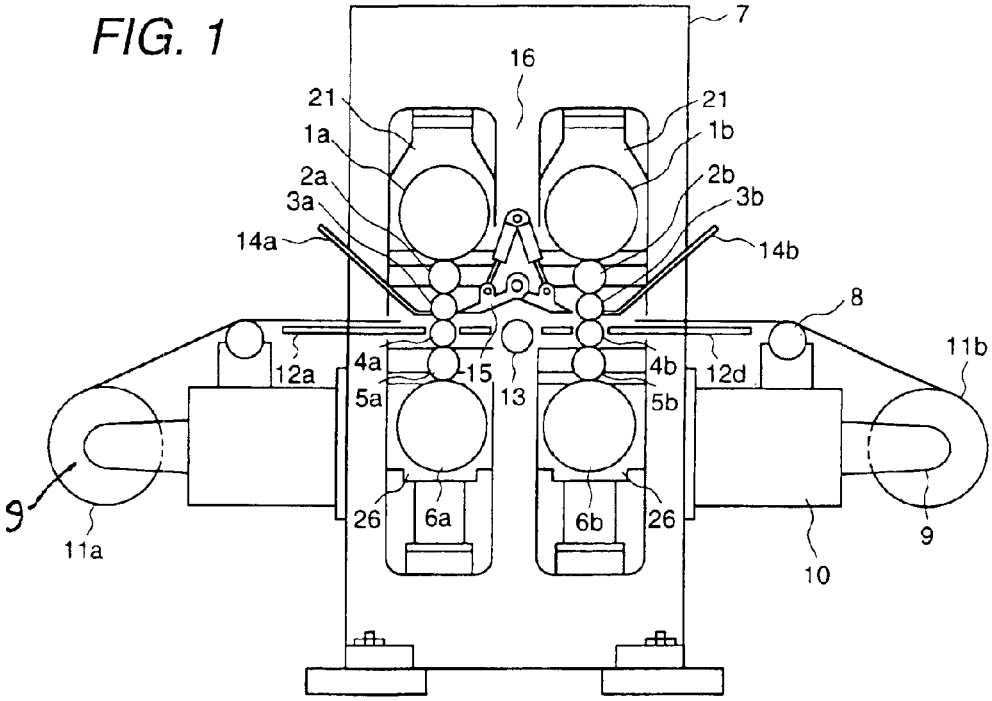
FIG. 1 is a front view of rolling equipment constructed according to a first embodiment of the present invention.

The above mentioned problems can be solved according to the invention by facilitating removal of the workpiece after rolling has stopped with the workpiece intervening between the roll groups.

A through-plate guide is provided in the rolling direction of the workpiece (namely, a direction almost vertical to the traveling direction of the workpiece) between two rows of roll groups, and at least one roll group is opened so that even if rolling stops with the workpiece intervening between the roll groups, the resulting clump of workpiece can be passed through the rolls. Accordingly, the workpiece can be removed from the open side.

Since a movable bender for assigning bending force is provided at the bearing box of the work rolls, since this bender has push-pull structure, and since the engagement section between the bender and the bearing box of the work rolls is distanced so as to be vertically symmetrical with respect to the center of pass of the workpiece, the work rolls can have a great opening allowance and it is also possible to prevent the work rolls from becoming caught at the workpiece between the roll groups when the rolls are removed from the rolling mill. With further reference to the engagement section of the bearing box which assigns bending force to the work rolls, in the case that this engagement section is located near the workpiece, the corresponding engagement section may not only restrict the opening operation of the work rolls in the direction opposite to the workpiece, but also protrude during removal of the rolls when the engagement section moves in the axial direction of the rolls in the rolling mill. Even if these events actually occur, however, the problem that the possible interference with the workpiece left between the roll groups may obstruct removal of the rolls can also be avoided.

With reference to at least one group (row) of rolls, at least one of the above-mentioned middle rolls or reinforced rolls in the rolling mill, except for the pair of work rolls, is constructed so as to be removable from the mill. In addition, a rail for removing the upper middle roll is provided and this rail can also be used to remove the upper reinforced roll when at least one of the two work rolls is moved. Hereby, even if the workpiece gets caught between the work rolls and the through-plate guide and prevents the work rolls from being removed, the rolls at rear can be removed and this makes the narrow section accessible for manual removal of the corresponding workpiece. For a conventional rolling mill, the lower reinforced roll has a table mounted on its bearing portion and the bearing portion of the upper reinforced roll is further mounted on this table, with the result that the upper reinforced roll can be inserted into and removed from the rolling mill. In this case, it is absolutely necessary to remove the work rolls beforehand, and the upper reinforced roll cannot be removed unless the work rolls can be removed. In the present invention, however, such a problem can be avoided. Furthermore, since the pull-out rail for the upper middle roll is constructed so as to be usable for the upper reinforced roll, it is possible to remove the upper reinforced roll without installing a special unit.

The through-plate guides between at least two sets of roll groups are constructed so as to be capable of withstanding the shock of plate rupture, and at least one of two through-plate guides has movable structure to enable removal of the workpiece even if it is left between two pairs of work rolls and the through-plate guides in the event of rolling trouble. Although rolling is associated with rolling trouble such as plate rupture or plate thinning-down, since the spaces between rolls and through-plate guides cannot be made as spacious as in the twin-stand reversing mill, the plate material will confinedly lodge in either such space if rolling trouble actually happens. At that time, the driving force of the rolling motor, the inertial force of the workpiece, and/or other significant shocks will be exerted on the through-plate guides. The through-plate guides are therefore constructed so as to be capable of withstanding the shocks. Also, the material, even if left between roll groups, can be removed by making at least one of the two through-plate guides movable and moving that guide so as to spread the corresponding space.

Since, at the roll removal side, two roll-side shifting units are arranged, one in front and one at rear, or one roll-side shifting unit is provided that enables at least four rows of roll groups to be arranged, it is possible to simultaneously change rolls between more than one pair of roll groups and to change either one pair of roll groups independently. Despite adjacent arrangement of the roll groups, therefore, roll changing operations equivalent to those of the twin-stand reversing mill are possible.

At least one multi-row rolling mill of the above-described configuration has been applied to the interior of a reversing cold-rolling mill or tandem rolling mill, in particular. In the case of a reversing cold-rolling mill, although portions not up to the desired thickness exist at both the leading and trailing ends of each coil, production yield can be improved since the clearances between roll groups can be reduced. In addition, the number of housings required can be reduced to one pair only and installation costs can also be saved more significantly than in the case of the twin-stand reversing mill. A large portion of tandem rolling mills are serialized and since they are of the unidirectional rolling type, although they are very high in yield, they are extremely large in scale and high in installation costs. The application of the above-described multi-row rolling mill, and its operating method, to at least one portion of such a tandem rolling mill enables space saving in addition to the implementation of an inexpensive tandem rolling mill.

Reducing the distance between roll groups in this way minimizes the waste of product coils, facilitates human access for removal of broken workpieces, and thus minimizes machine component recovery time. The equipment itself can also be made compact and this enables space saving and inexpensive installation.

(Embodiment 1)

An embodiment of the present invention is described below using drawings. FIG. 1 is a front view of a multi-stage rolling mill constructed according to a first embodiment of the invention.

The multi-stage rolling mill shown in FIG. 1 has two roll groups, "a" and "b". The first roll group comprises an upper reinforced roll 1*a*, an upper middle roll 2*a*, an upper work roll 3*a*, a lower work roll 4*a*, a lower middle roll 5*a*, and a lower reinforced roll 6*a*. The second roll group comprises an upper reinforced roll 1*b*, an upper middle roll 2*b*, an upper work roll 3*b*, a lower work roll 4*b*, a lower middle roll 5*b*, and a lower reinforced roll 6*b*. The arrangement with these two roll groups consisting of six stages is taken as an example in the following description of the first embodiment.

The two roll groups in this rolling mill are contained and accommodated in a housing 7. A deflector roller 8, a tension reel 9, and a frame 10 for supporting the deflector roller and the tension reel, are arranged in the rolling direction on both sides in the mill. That is to say, tension reel 9 is located on both sides of the multi-stage rolling mill.

A coil-like workpiece 11 is sent, as coil workpiece 11*a*, from one tension reel 9 via the multi-stage rolling mill to the other tension reel 9, where the workpiece is then wound as coil workpiece 11*b*. During this process, workpiece 11 is rolled using the upper and lower pairs of roll groups: upper work roll 3*a*, lower work roll 4*a*, upper work roll 3*b*, and lower work roll 4*b*.

At the bottom of the pass line in housing 7, a lower through-plate guide 12 (12*a*, 12*b*) and a tension roller 13 are arranged to guide the workpiece 11, and at the top of the pass line, an upper entrance guide 14*a*, an exit guide 14*b*, and an upper through-plate guide 15 are arranged. Also, a center post 16 is provided as a columnar member in the center of housing 7 in the rolling direction, between the two roll groups. The clearance between the two roll groups can be reduced by adopting such configuration.

Figure 12:
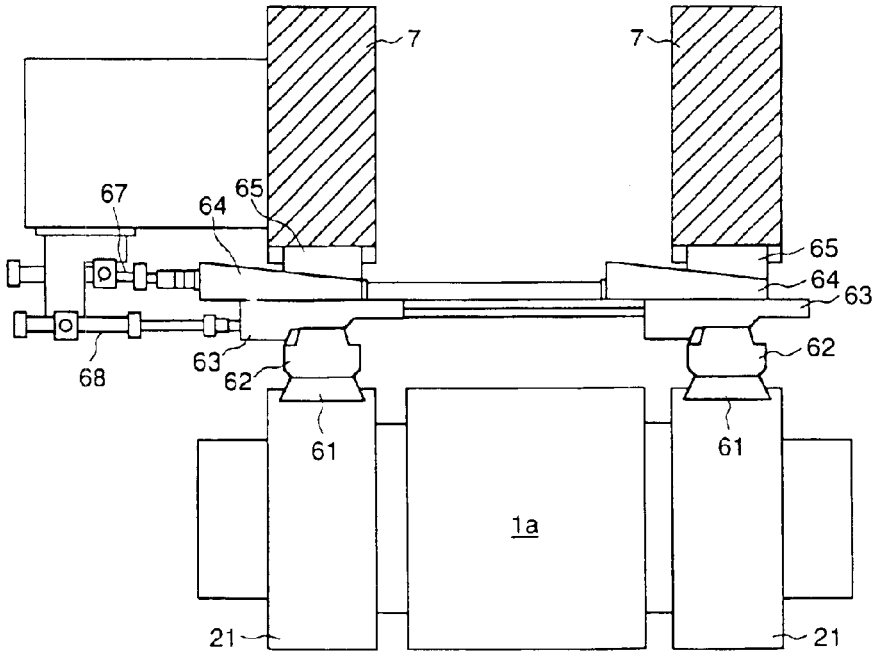
FIG. 12 is a partial cross-sectional view showing a pass line adjustment mechanism constructed according to an embodiment of the invention.

In addition, a roll group clearance adjustment mechanism is provided at the top of the roll groups as shown in, for example, FIG. 12. Another adjustment mechanism is also provided between an upper reinforced roll chock 21, which functions as a bearing for upper reinforced roll 1*a*, and housing 7. Between upper reinforced roll chock 21 and housing 7, a rocker plate 61 is provided at the top of upper reinforced roll chock 21, and an adjustment block 62 is provided at the top of rocker plate 61, and a stepped rocker plate 63 and an inclined rocker plate 64 are arranged at the top of adjustment block 62. Inclined rocker plate 64 engages with an inclined block installed on housing 7. A cylinder 67, a cylinder 68, and other driving components are provided for stepped rocker plate 63 and inclined rocker plate 64 each in order to move these rocker plates in the axial direction of the rolls, and the vertical position of upper reinforced roll 1*a* can be adjusted by adjusting the positions of stepped rocker plate 63 and inclined rocker plate 64 in the axial direction of the rolls by use of cylinders 67 and 68. Vertical adjustment of upper reinforced roll 1*a* enables height adjustment of the upper portions of the roll groups (namely, pass line adjustment), and the adjustment of the clearance between one pair of work rolls.

Figures 2, 2A:
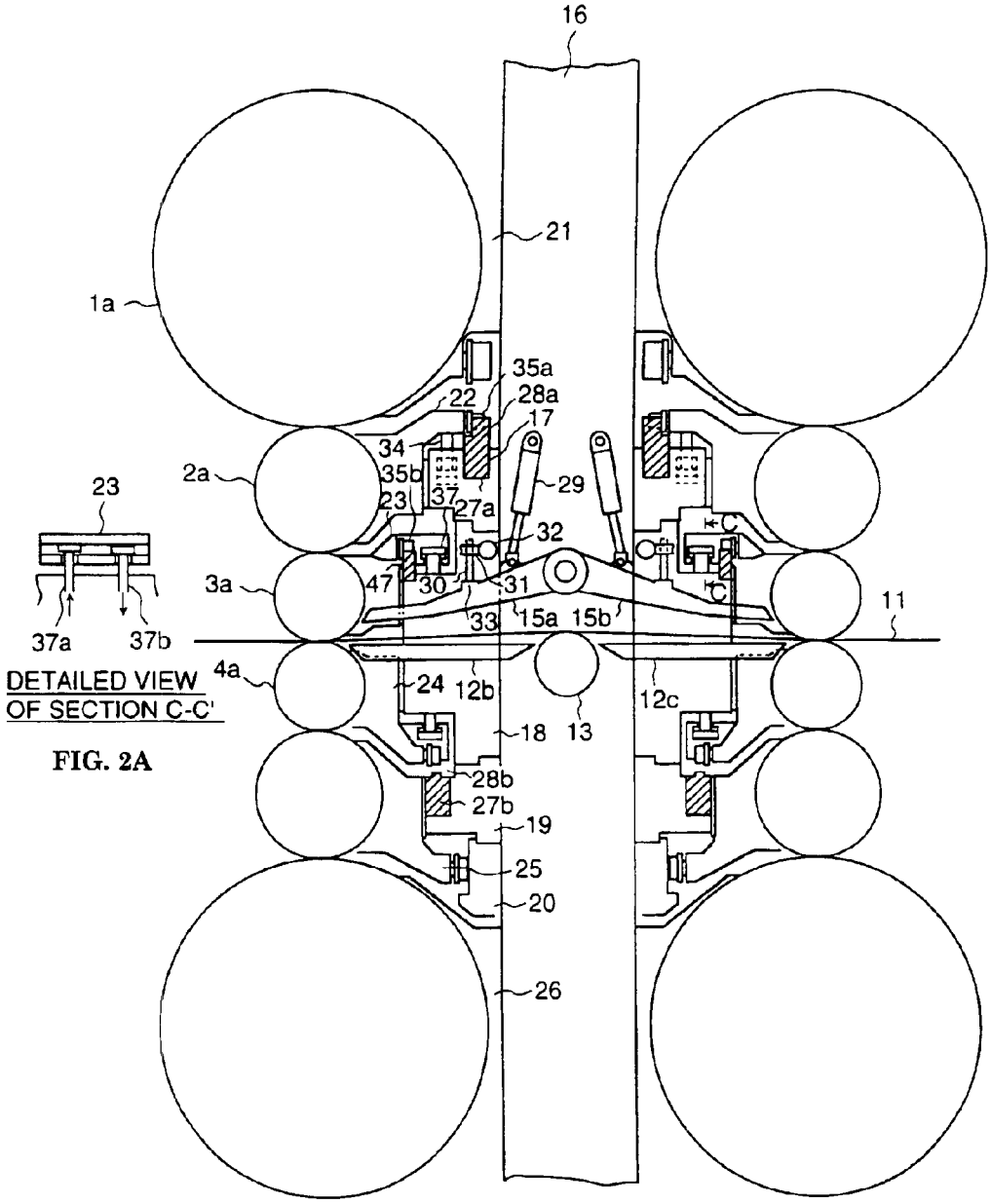
FIG. 2 is a partial cross-sectional view of the rolling equipment of FIG. 1.
FIG. 2A is a detailed view of a portion of the FIG. 2 equipment.

Next, an enlarged cross-sectional view showing the center of a rolling mill based on the present invention is shown as FIG. 2. This figure also shows the machine configuration between two roll groups.

As shown in FIG. 2, an upper middle roll bending block 17, an upper/lower work roll bending block 18, a lower middle roll bending block 19, and a lower middle roll changing rail 20 are arranged at center post 16. An upper reinforced roll chock 21, an upper middle roll chock 22, an upper work roll chock 23, a lower work roll chock 24, a lower middle roll chock 25, and a lower reinforced roll chock 26 are mounted at the operating end (roll removal side) and driving end of each roll.

FIG. 2 only shows the right-half or left-half of the roll center line of each roll group, and each bending block and other related components are arranged symmetrically with respect to the roll center line of each roll group.

Upper middle roll bending block 17 is equipped with a connecting rod 27*a* at both the operating end and driving end thereof, and a roll changing rail 28 is provided at a portion of the connecting rod. Lower middle roll bending block 19 is also equipped with a connecting rod 27*b* at both the operating end and driving end thereof, and a roll changing rail 28 is provided at a portion of the connecting rod.

Upper/lower work roll bending block 18 also has an upper work roll changing rail 47 at a portion thereof, and the upper work roll 3*a*, when in engagement with a roll changing wheel 35 provided at upper work roll chock 23, can be removed from the operating end of the rolling mill independently.

Upper through-plate guide 15 is driven vertically by a vertical driving cylinder 29. The movement of this guide is stopped by a stopper 30.

In this embodiment, an upper through-plate guide 15*a* and an upper through-plate guide 15*b* are provided at the "a" side and "b" side, respectively, of the roll groups. One end of upper through-plate guide 15*a*, for example, is located for the desired clearance with respect to the outer surface of upper work roll 3*a*, and the other end is mounted on center post 16 so as to work as the rotational fulcrum of the upper through-plate guide 15*a*. The top end of upper through-plate guide 15*a* has a cylinder 29, one end of which is mounted on center post 16 and the other end is connected to upper through-plate guide 15*a*. The operation of the cylinder 29 rotates the other end of upper through-plate guide 15*a* as a rotational fulcrum. Upper through-plate guide 15*b* has a similar construction. More specifically, cylinder 29 mentioned above is provided as the shifting unit that moves upper through-plate guide 15 from the position at which the traveling of the workpiece is to be guided, to any other position. Since there is provided at least one upper through-plate guide 15 having a lift, this guide enables appropriate response to the stoppage of workpiece 11.

The arrangement with both a worm gear 31, which meshes with stopper 30, and a worm gear 32, which further meshes with work gear 31, allows the positioning of stopper 30. A portion of upper through-plate guide 15 has a receiving face 33, which engages with stopper 30.

Also, upper through-plate guide 15 is mounted on center post 16. Since, in this way, upper through-plate guide 15 is installed on center post 16, not at the roll bearing box, the equipment permits easy maintenance and its structure can be simplified. That is to say, the roll bearing box usually requires roll replacement associated with the surface friction of the rolls, and the roll bearing box and the rolls are replaced frequently in integrated form. For this reason, a plurality of roll sets (roll bearing boxes and rolls) exist and are used each time. To install upper through-plate guide 15 on each roll bearing box, therefore, it is necessary to install this guide for each roll set, and as a result, installation costs increase. The installation of upper through-plate guide 15 on each roll bearing box also inconveniences maintenance. In this embodiment, since upper through-plate guide 15 is installed on center post 16 of the rolling mill, not at the roll bearing box, the equipment permits easy maintenance and its structure can be simplified.

For normal rolling conditions, it is desirable that as shown in FIG. 2, one end of upper through-plate guide 15 should be slightly distanced from the outer surface of upper work roll 3*a*. Workpiece 11 can be guided smoothly between upper and lower work rolls 3*a* and 4*a*, and rolled, by positioning one end of upper through-plate guide 15 that way. It is also desirable that there be provided a mechanism by which the clearance from the outer surface of upper work roll 3*a* can be adjusted to the desired value according to the particular operating diameter of the work rolls. For example, it is possible to set one end of upper through-plate guide 15 easily to a position close to the outer surface of upper work roll 3*a*, or to achieve follow-up with the operating diameter of the work rolls, by providing a lift that drives upper through-plate guide 15 vertically.

During this phase, in case of trouble due to an unusual event such as plate breakage, workpiece 11 stops moving between lower through-plate guide 12 and upper through-plate guide 15, and consequently, the rolling production operations are stopped. This event also occurs between the two stands of the twin-stand reversing mill. The workpiece that has stopped moving needs to be removed for early recovery from such a situation.

First, the work rolls need to be opened in the direction opposite to workpiece 11. Next, workpiece 11 that has stopped moving is to be removed towards tension reel 9. Under some specific states of the corresponding workpiece 11, it can be removed by conducting these operations. Workpiece 11 can be removed by, for example, increasing the clearance between the upper and lower work rolls 3*a* and 4*a* of one roll group by use of the roll group clearance adjustment mechanism first and then pulling the workpiece out through the increased clearance.

Figure 3A:
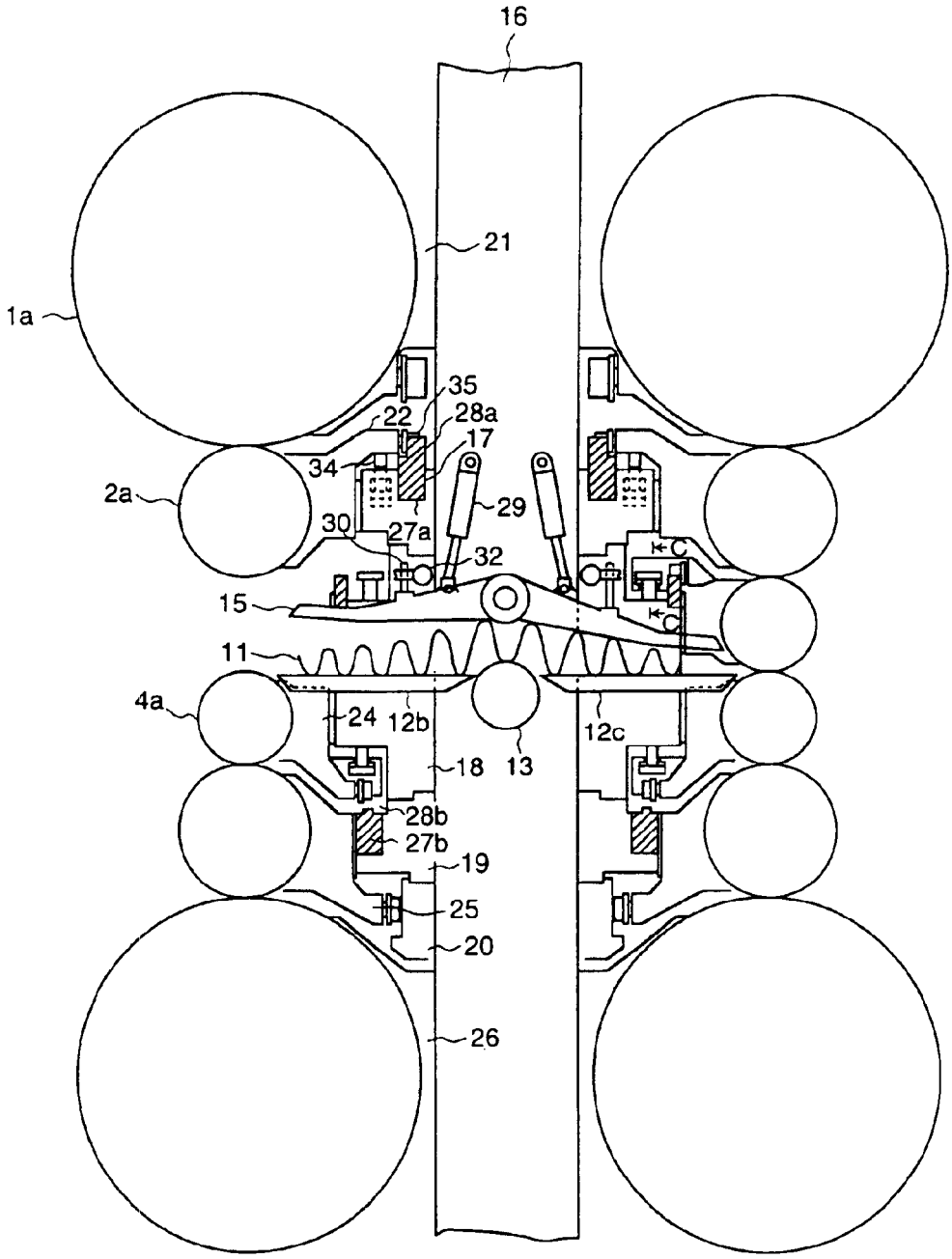
FIG. 3(*a*) is another partial cross-sectional view of the rolling equipment of FIGS. 1 and 2.
Figure 3B:
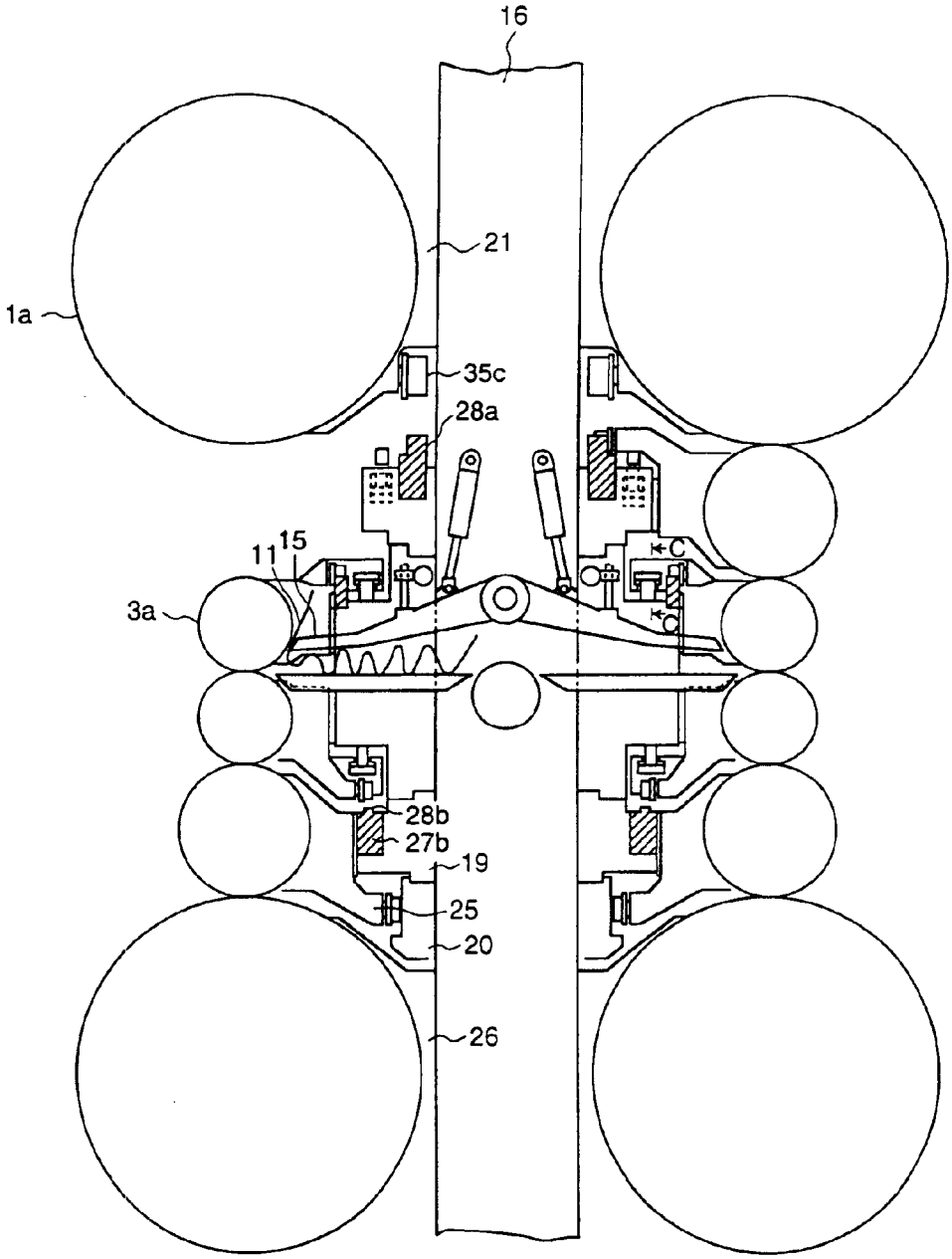

However, the following method is required if the way the work rolls are clogged with workpiece 11 is too tough for its removal using the method described above. That is to say, roll changing wheel 35 which has upper work roll 3*a* positioned at upper work roll chock 23 is to be traveled along work roll changing rail 47 and then the workpiece is to be removed towards the operating side of the rolling mill independently. FIG. 3(*a*) is an explanatory view of a rolling mill whose upper work roll 3*a* was removed from one of the roll groups shown in FIG. 2. Removal of upper work roll 3*a* from the rolling mill creates a sufficient clearance between upper middle roll 2*a* and lower work roll 4*a*, thus enabling easy removal of the workpiece 11 that has stopped.

After that, the workpiece 11 that has stopped can be removed by moving stopper 30 upward and then also moving upper through-plate guide 15 by use of vertical driving cylinder 29. The vertical operation of upper through-plate guide 15 enables space adjustment and, hence, easy removal of the workpiece 11 that has stopped. In other words, the space for removal can be reserved by sliding upper through-plate guide 15 out from the guiding position to the desired position and moving the guide away from the guiding area. Equipment structure can be simplified by including, in the machine configuration of this embodiment, the means for sliding upper through-plate guide 15 out from the guiding position to the desired position and moving the guide away from the guiding area.

The removal space can be further spread by moving tension roller 13 downward for easier removal. More specifically, removal can be further simplified by proving a vertical driving unit, such as a cylinder, that moves tension roller 13 vertically.

FIG. 3(*b*) is an explanatory view of a rolling mill whose upper middle roll 2*a* was removed from one of the roll groups shown in FIG. 2. Upper work roll 3*a* may not be readily removable if workpiece 11 has stopped moving between upper work roll 3*a* and upper through-plate guide 15. In that case, both upper middle roll 2*a* and upper middle roll chock 22 are to be lifted together by operating middle roll bending cylinder 34 and then roll changing wheel 35 is to be traveled along rail 28*a* to remove upper work roll 3*a*. In this way, upper work roll 3*a* can be removed by creating a space at upper middle roll 2*a*, then making access to the equipment, and manually cutting a portion of workpiece 11. Once the upper work roll has thus been removed, it will be possible, as shown in FIG. 3(*a*), to create a clearance between upper and lower work rolls 3 and 4 by lifting upper through-plate guide 15 and then to remove the workpiece 11 that has stopped. If the space at upper middle roll 2*a* does not suffice, a sufficient space can be obtained by pulling upper reinforced roll 1*a* out along roll changing rail 28.

In this way, it is possible to obtain a workpiece removal space by removing the desired roll or by sliding upper through-plate guide 15 from the guiding position to any other position and moving this guide away from the guiding area, and then to remove easily the workpiece 11 that has stopped moving inside the rolling mill.

It is desirable that lower through-plate guides 12*b* and 12*c* and upper through-plate guide 15 should have highly rigid structure so as not to get deformed against shocks due to plate rupture or other unusual events.

(Embodiment 2)

Figure 4:
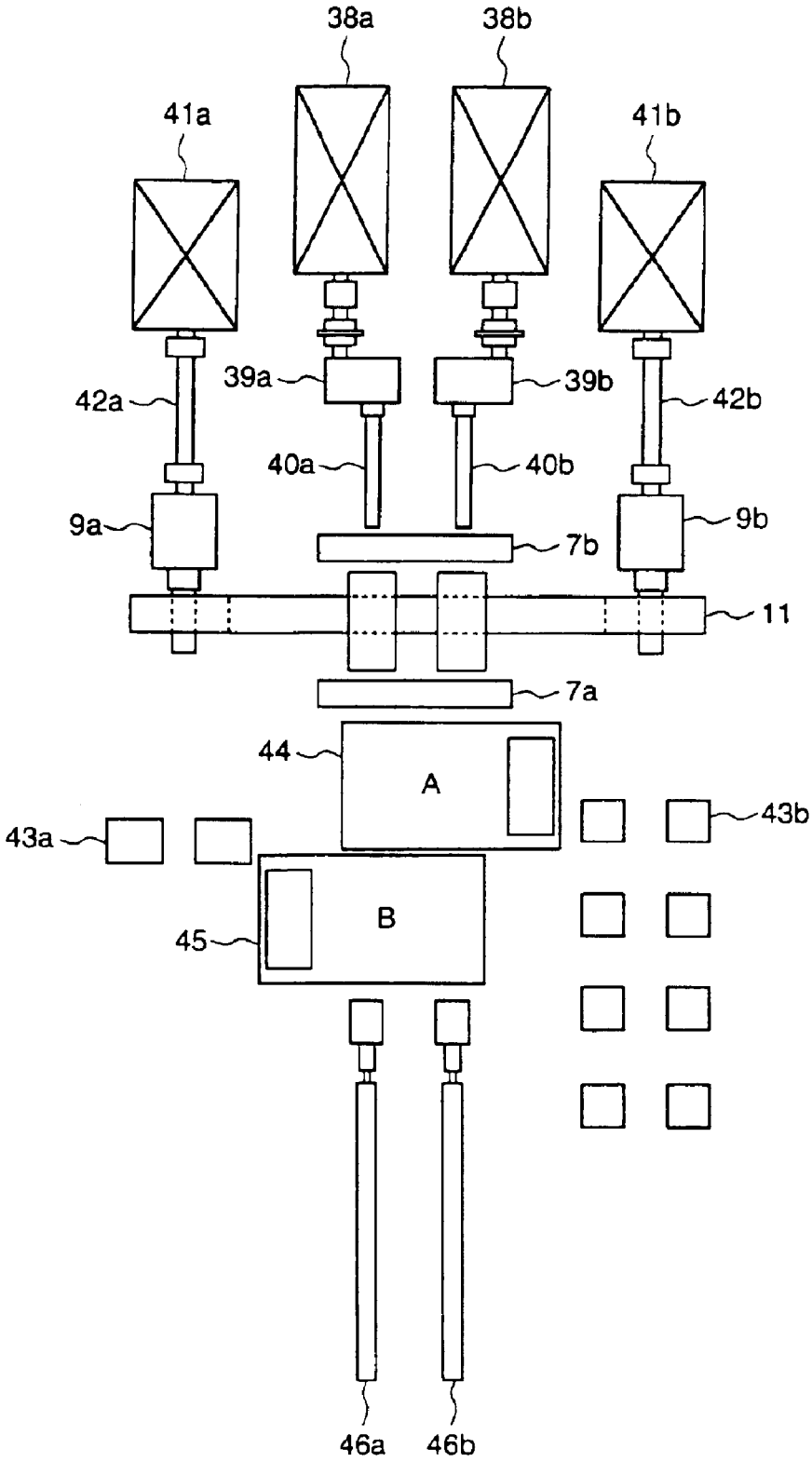
FIG. 4 is a top plan view of rolling equipment constructed according to another embodiment of the present invention.

FIG. 4 is a plan view showing another embodiment of the present invention. The equipment in this embodiment comprises motors 38*a* and 38*b* for rotationally driving rolls, reduction gears 39*a* and 39*b* for obtaining a suitable rotational speed, and spindles 40*a* and 40*b* for transmitting a torque to the rolls. These components drive the rolls rotationally for workpiece rolling operations.

Both tension reels 9*a* and 9*b* have a driving motor 41*a* or 41*b* and a driving spindle 42*a* or 42*b*, and these components give suitable tension to workpiece 11 for its rotational driving.

In the equipment, a roll changing unit for rapidly changing the respective rolls of two roll groups is provided at the operating side of the rolling mill, namely, the opposite side of its driving means.

For this roll changing unit, a coil placement table 43*a* or 43*b* for workpiece 11 is provided at both sides of the rolling direction, at the operating side of the rolling mill. For this reason, side shifting carts A44 and B45 for roll changing are also provided in front and at rear. The rolling mill driving means, the rolling mill, and side shifting carts A44 and B45 for roll changing are arranged in that order in the lateral direction of the workpiece. Push-pullers 46*a* and 46*b* that push and pull out the respective rolls of the roll groups for removal and insertion, respectively, are further arranged for roll changing.

Embodiments of the roll replacement methods using the equipment of FIG. 4 are described below. Rolls can be replaced by changing two roll groups at the same time or by replacing one roll group. These methods are described below using FIGS. 5 and 6, respectively.

Figure 5:
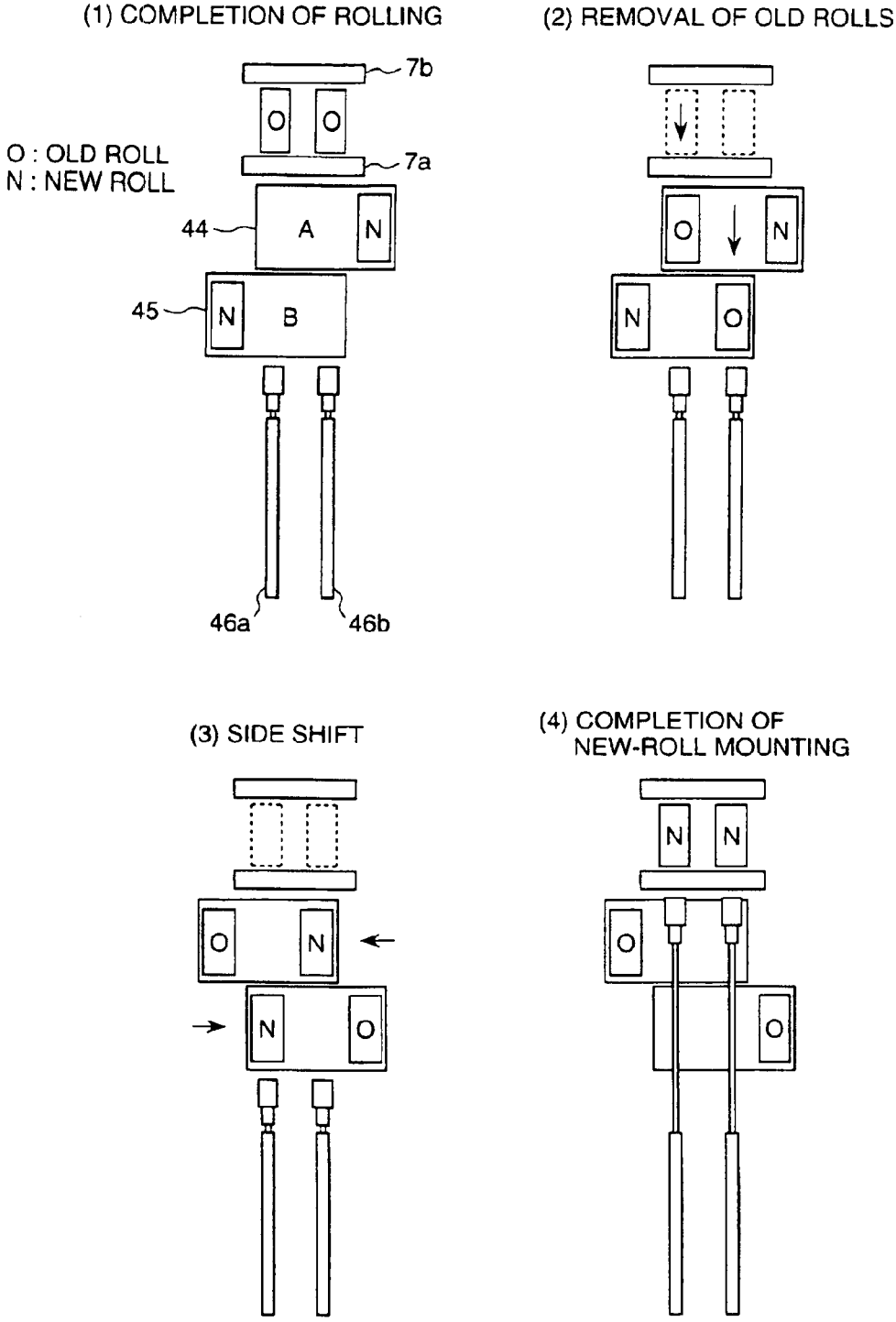
FIG. 5 is a plan view showing a roll replacement procedure according to a preferred embodiment of the invention.

FIG. 5 is an explanatory view showing the method of changing two roll groups at the same time. This method comprises a first process, a second process, a third process, and a fourth process. Symbol O in FIG. 5 denotes an old roll, and likewise, symbol N denotes a new roll.

The method where the circle-marked old rolls in the rolling mill are to be replaced for reasons such as roll surface roughness or unusual wear, is as follows:

In the first process, before rolling is completed, new rolls (N) are placed at the positions shown in the figure, on roll-changing side shifting carts A44 and B45, and then rolling is completed. Next, in the second process, push-puller 46 is moved forward and backward and the old rolls (O) are pulled out onto roll-changing side shifting carts A44 and B45. After this, in the third process, the side shifting carts are moved to move the new rolls (N) to the centers of the respective roll groups. Finally, in the fourth process, the respective roll groups are re-inserted into the rolling mill by moving push-puller 46 forward to complete the insertion of the new rolls (N), and then push-puller 46 is reversed to return to the position existing when the first process was performed.

As described above, simultaneous roll replacements between two roll groups can be easily performed using the above method.

Figure 6:
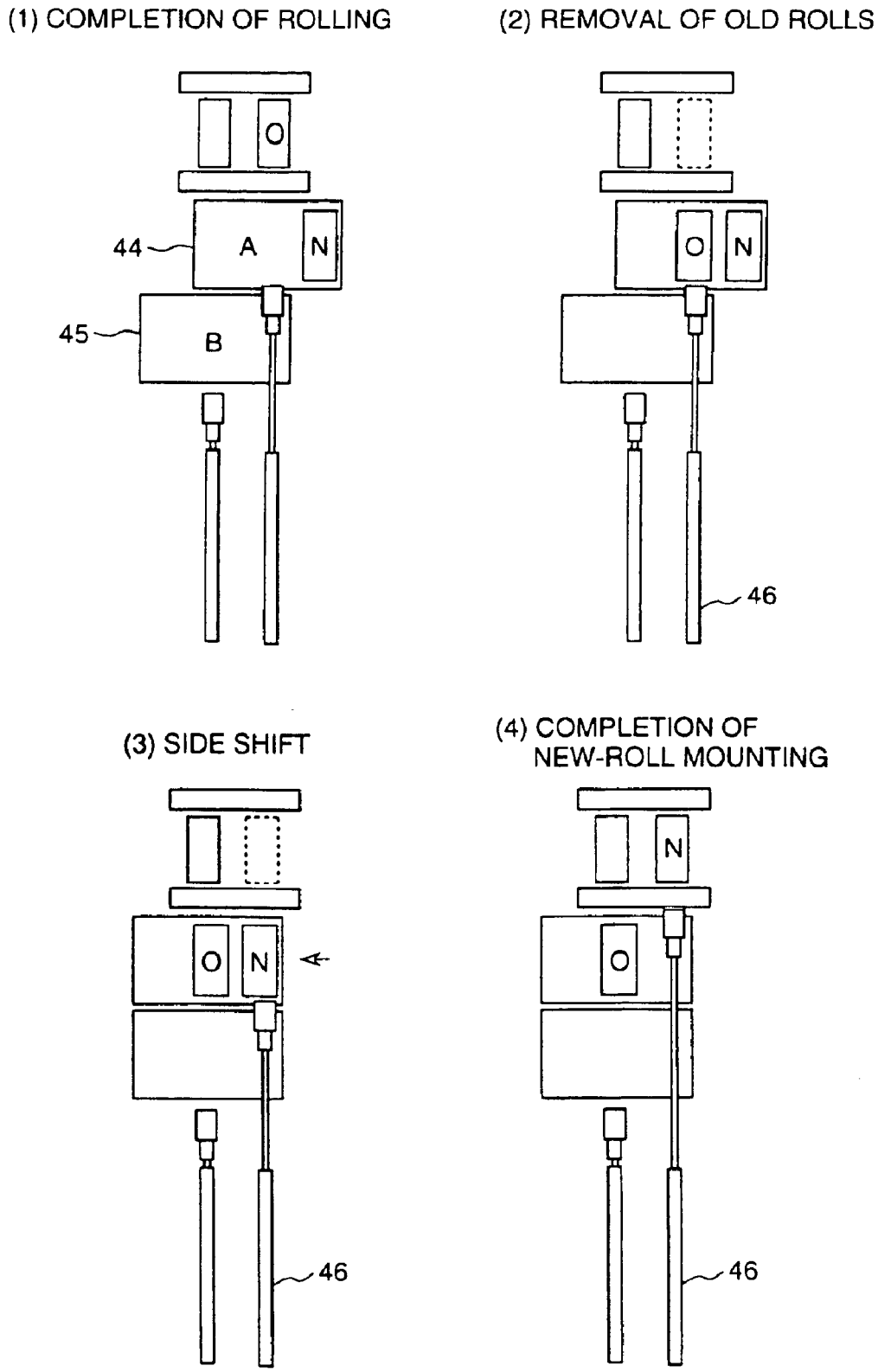
FIG. 6 is another plan view showing a roll replacement procedure according to a preferred embodiment of the invention.

FIG. 6 is an explanatory view showing the method of replacing one roll group. In this case, roll-changing side shifting cart B45, for example, is not used. In the first process, before rolling is completed, a new roll (N) is placed on roll-changing side shifting cart A44, and then rolling is completed. Next, in the second process, push-puller 46 is moved forward and backward and the old roll (O) is pulled out onto roll-changing side shifting cart A44. After this, in the third process, the side shifting cart is moved to move the new roll (N) to the center of the corresponding roll group. Finally, in the fourth process, the roll group is re-inserted into the rolling mill by moving push-puller 46 forward to complete the insertion of the new roll (N), and then push-puller 46 is reversed to return to the position existing when the first process was performed. The forward/backward movement stroke of push-puller 46 in this case is shorter than in the case that two roll groups are replaced at the same time.

Figure 7:
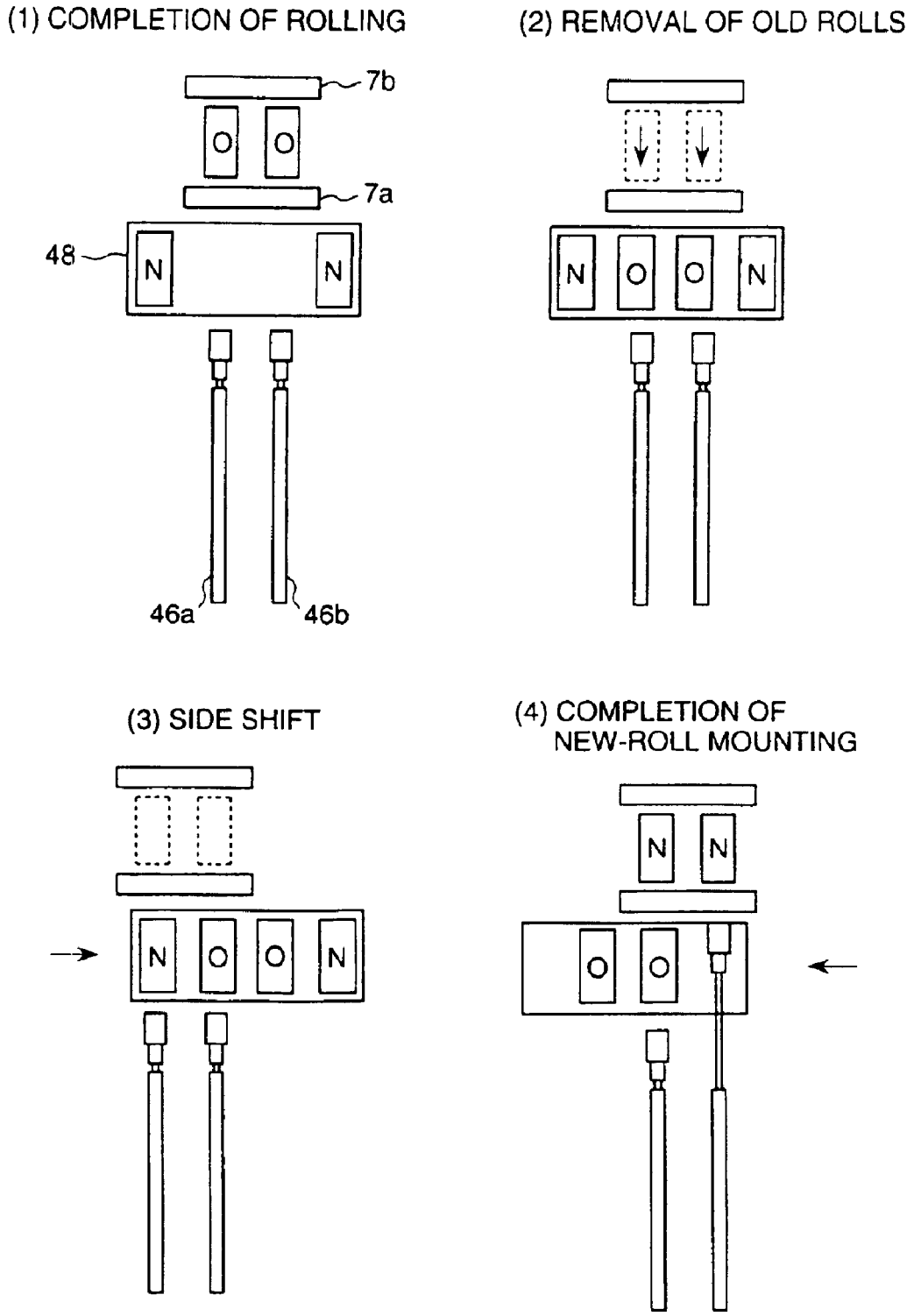
FIG. 7 is yet another plan view showing a roll replacement procedure according to a preferred embodiment of the invention.

FIG. 7 is an explanatory view showing the roll replacement method that uses one side shifting unit. In this figure, roll-changing side shifting cart C48 has the structure that enables four rows of roll groups to be arranged. In the first process, before rolling is completed, new rolls (N) are placed on roll-changing side shifting cart C48, and then rolling is completed. Next, in the second process, push-puller 46 is moved forward and backward and the old rolls (O) are pulled out onto roll-changing side shifting cart C48. After this, in the third process, side shifting cart C48 is moved to move the new rolls (N) to the centers of the respective roll groups. Finally, in the fourth process, the respective roll groups are re-inserted into the rolling mill by moving push-puller 46 forward to complete the insertion of the new rolls (N), and then push-puller 46 is reversed to return to the position existing when the first process was performed. Replacement of one roll group uses a portion of the side guides and occurs as shown in FIG. 6.

(Embodiment 3)

Figure 8:
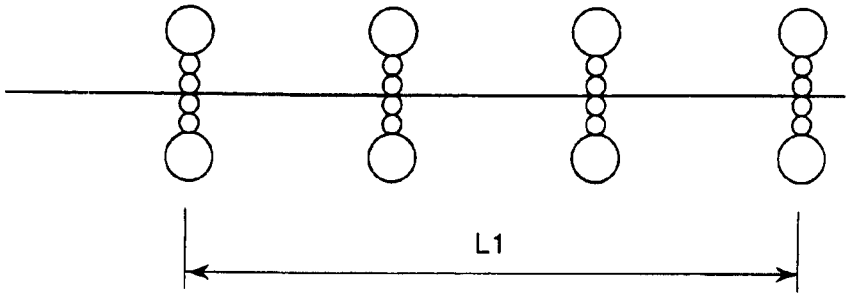
FIG. 8 is an arrangement view of tandem rolling mills constructed according to another embodiment of the invention.
Figure 9:
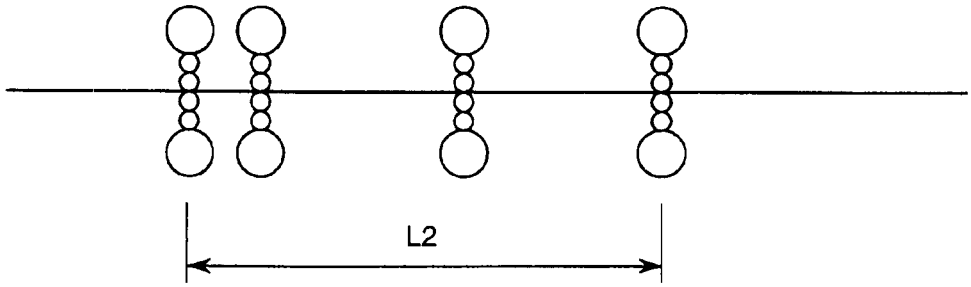
FIG. 9 is another arrangement view of tandem rolling equipment constructed according to an embodiment of the present invention.
Figure 10:
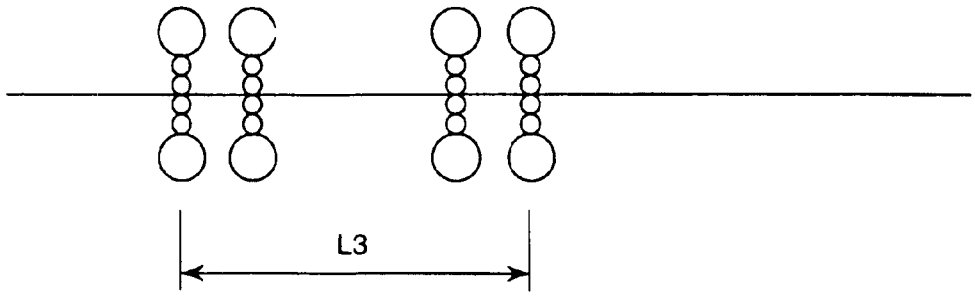
FIG. 10 is yet another arrangement view of tandem rolling equipment constructed according to an embodiment of the present invention.

FIG. 8 is a view of a conventional tandem rolling mill. Similarly, FIG. 9 is a view showing an example in which a multi-row rolling mill based on the present invention is applied to a tandem rolling mill, and FIG. 10 is a view showing another example in which a multi-row rolling mill based on the present invention is applied to a tandem rolling mill. For the purpose of comparison with a conventional four-stand tandem rolling mill, the overall lengths of the three types of equipment are shown as L1, L2, and L3, in the figures. The stand-to-stand distance in FIG. 8 is 5 m, whereas that of the multi-row rolling mill is 1.8 m. Hence, the equipment in the case of L2 can be reduced to a length 3.2 m shorter than in the case of L1, and L3 is 6.4 m shorter, which indicates that the equipment can be reduced by 42.7% in length.

Although all the above-described embodiments of the present invention apply to the case that the rolling mill has six stages of roll groups, the same also applies to a four-stage rolling mill and a six-stage rolling mill. Also, although the above embodiments relate to cold-rolling mills, the art of the present invention can also be applied to hot-rolling mills. Application to cold-rolling mills, however, is expected to produce more significant effects.

Bending cylinder 37 in upper/lower work roll bending block 18 usually performs increase bending and decrease bending operations during rolling. During increase bending, no problems arise since upper work roll chock 23 is pushed upward as shown in FIG. 2. During decrease bending, however, since upper work roll chock 23 is pushed downward, the resulting clearance between upper work roll chock 23 and bending cylinder 37 creates the undesirable situation that a dead zone in bending operation occurs during increase/decrease bending mode selection. The occurrence of this dead zone in bending operation can be prevented by providing a special bending cylinder 37*a* for pushing and a special bending cylinder 37*b* for pulling. See the detailed view of section C–C' in FIG. 2A.

Figure 11:
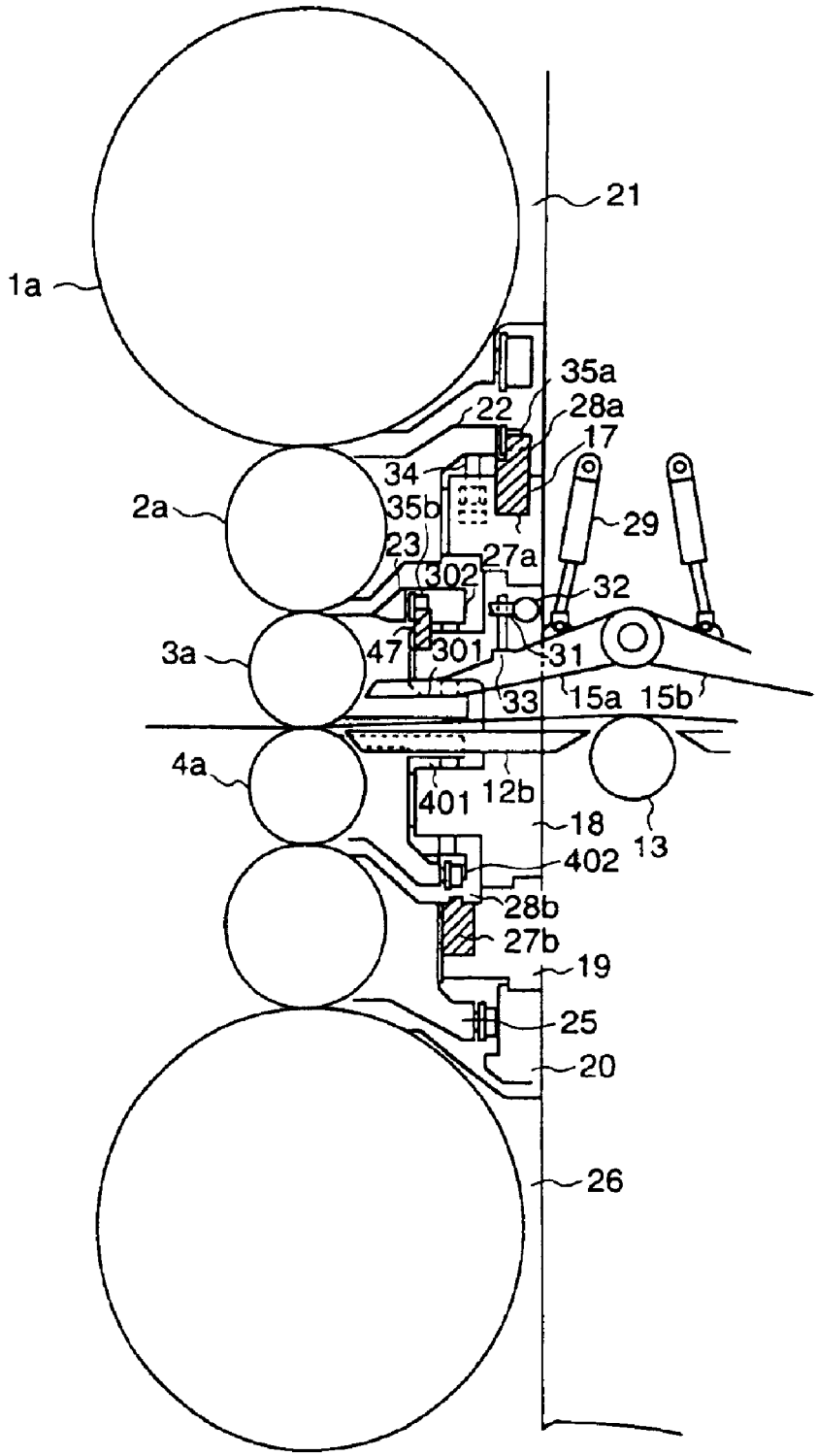
FIG. 11 is a partial cross-sectional view of a rolling mill whose work roll bearing box has a bending force assigning section located near the material to be rolled constructed according to an embodiment of the invention.

FIG. 11 is a view showing the case that the bending force assigning section of the work roll bearing box is located near the material to be rolled. Upper work roll chock 23 has collar portions 301 and 302 for receiving the bender, and lower work roll chock 24 also has collar portions 401 and 402 for receiving the bender. The presence of the collar portions 301 and 401 becomes a problem. Collar portion 301 becomes a restriction on the trade-offs with upper/lower work roll bending block 18 when the upper work roll is lifted. Also, when this collar portion is present, the structure of upper through-plate guide 15 becomes complex since this upper through-plate guide needs to be retracted during removal of the work rolls from the rolling mill. In addition, even if the upper through-plate guide has successfully been retracted, if the workpiece is left between roll groups, the rolls may not be removable because of their possible interference with the corresponding collar portion. Collar portion 401 also creates a similar undesirable situation. It is preferable, therefore, that as shown in FIG. 2A, the bender for assigning bending force to the work roll bearing box should be of push-pull structure and that the engagement section between the bender and the work roll bearing box should be distanced so as to be vertically symmetrical with respect to the center of pass of the workpiece. When only the increase bender is required, push-pull is not required and only pushing is required.

Although the push-puller 46 (46*a*, 46*b*) that pushes and pulls out the respective rolls of the roll groups for removal and insertion, respectively, may use a hydraulic cylinder type, a motor-driven cart type, or the like, any such type of push-puller can be applied.

According to the embodiments described above, product yields can be improved by reducing the clearance between two groups of rolls. Also, even in case of trouble such as the rupture of the workpiece, the availability of the rolling equipment also improves since its components can be recovered rapidly. In addition, space saving and reduction in installation costs can be achieved.

The present invention yields the effect that the recoverableness of the rolling mill from rolling trouble can be improved by reducing the distance between roll groups.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A multi-row rolling mill having in one housing at least two groups of rolls, each group including at least one pair of work rolls, provided with a columnar support member between said roll groups, and constructed so that by one pass of a workpiece, the workpiece can be rolled by said respective work rolls, wherein the multi-row rolling mill is characterized by comprising a removal supporting means between said roll groups in said housing for facilitating removal of a work piece stopped between said roll groups said removal supporting means comprising:

through-plate guides arranged along a workpiece traveling direction so that one end of one of said through-plate guides face the work roll of one of said roll groups and one end of the other through-plate guide faces the work roll of the other roll group, and disposed at a first position spaced a first distance from said respective work rolls, for guiding traveling of said work piece between said roll groups during rolling operation, and a unit for moving respective ones of said through-plate guides, from said first position to a second position to broaden a space for removal of said work piece, wherein said through-plate guides for guiding said workpiece each are mounted on said columnar support member at an end thereof opposite to said end facing said work roll, and wherein said unit being for independently moving said through-plate guides so that said end of at least one of said through-plate guides, facing said work roll, moves from said first position to said second position.

2. A multi-row rolling mill as set forth in claim 1, wherein the multi-row rolling mill is characterized in that a movable bender for assigning bending force is provided at a roll chock of said work rolls and in that an engagement section between said bender and said roll chock is disposed so as to be vertically symmetrical with respect to a center of pass of the workpiece.

3. A multi-row rolling mill as set forth in claim 1, wherein the multi-row rolling mill is characterized in that at least one of the groups of rolls consists of one pair of work rolls, one pair of middle rolls for supporting said pair of work rolls, and one pair of reinforced rolls for supporting said pair of middle rolls, and in that a pull-out rail is provided so that under a status that at least one roll of said pair of work rolls is left inside the rolling mill, at least one of said middle rolls or reinforced rolls, other than the other work roll left inside the rolling mill, can be pulled out to the outside of the mill.

4. A multi-row rolling mill as set forth in claim 1, wherein the multi-row rolling mill is characterized in that said through-plate guides each are mounted on said columnar support member located between said roll groups and independently movable by said unit.

5. A multi-row rolling mill having in one housing at least two groups of rolls, each group including at least one pair of work rolls, and a columnar support member between said roll groups, and constructed so that by one pass of a workpiece to be rolled, the workpiece can be rolled by said respective work rolls, wherein a removal supporting means for facilitating removal of a workpiece stopped between said roll groups is mounted on said columnar support member, said removal supporting means comprising through-plate guides, arranged between said roll groups along a workpiece traveling direction so as to be spaced from said respective work rolls, for guiding said workpiece between said at least two roll groups, and a moving mechanism for moving sad through-plate guides independently from each other to enlarge a space for the removal of the workpiece, and wherein said through-plate guides each are mounted on said columnar support member to be movable around a supported portion thereof, said through-plate guides each having an end close to one of said work rolls, and said moving mechanism is constructed to move said ends of said through-plate guides so as to extend said space for the workpiece by rotation of at least one of said through-plate guides.

* * * * *